US008282297B2

(12) United States Patent
Ryan et al.

(10) Patent No.: US 8,282,297 B2
(45) Date of Patent: Oct. 9, 2012

(54) ADJUSTABLE CARTRIDGE PEN HOUSING

(75) Inventors: Steven T. Ryan, Westminster, CA (US); Douglas J. Port, Huntington Beach, CA (US)

(73) Assignee: Surefire, LLC, Fountain Valley, CA (US)

( * ) Notice: Subject to any disclaimer, the term of this patent is extended or adjusted under 35 U.S.C. 154(b) by 889 days.

(21) Appl. No.: 12/316,278

(22) Filed: Dec. 11, 2008

(65) Prior Publication Data

US 2010/0150639 A1 Jun. 17, 2010

(51) Int. Cl.
*B43K 5/16* (2006.01)

(52) U.S. Cl. ..... 401/116; 401/99

(58) Field of Classification Search ..... 401/68–70, 401/90, 95, 96, 235, 99, 116, 195
See application file for complete search history.

(56) References Cited

U.S. PATENT DOCUMENTS

| | | | | | |
|---|---|---|---|---|---|
| 1,349,025 | A | * | 8/1920 | Wahl | 401/70 |
| 1,681,842 | A | * | 8/1928 | Collen | 401/8 |
| 2,546,195 | A | * | 3/1951 | Mellette | 401/69 |
| 3,115,118 | A | * | 12/1963 | Anderson et al. | 401/75 |
| 3,191,768 | A | * | 6/1965 | Davis | 401/63 |
| 5,244,299 | A | * | 9/1993 | Chu | 401/195 |
| 5,263,786 | A | * | 11/1993 | Kageyama | 401/111 |
| 5,568,741 | A | * | 10/1996 | Parsons | 70/456 R |
| 5,927,883 | A | * | 7/1999 | Lebauer | 401/116 |
| 6,386,780 | B1 | * | 5/2002 | Brummernhenrich | 401/192 |

* cited by examiner

*Primary Examiner* — Huyen Le
(74) *Attorney, Agent, or Firm* — Lulit Semunegus

(57) ABSTRACT

A writing instrument having a housing accommodating various sizes and lengths of cartridges fixed inside the housing by an adjustable control element. In its correct placement, the cartridge will abut against one end of the control element and will be held in place with a spring at the other end, such that the user may write steadily with the pen.

17 Claims, 4 Drawing Sheets

ADJUSTABLE CARTRIDGE PEN HOUSING

BACKGROUND

1. Field of the Invention

The present invention relates to a pen housing that can be adjusted to accommodate commercially available ink cartridges of various sizes.

2. Related Art

A typical pen has a housing that holds a cartridge, which commonly comprises an ink reservoir and a writing mechanism to which the ink is delivered. The housing holds the cartridge in the correct position so that a user may write with the pen. The housing may be adapted for a single-use cartridge, or it may accommodate replacement cartridges.

A cartridge typically has a writing tip end and a butt end. In prior art pens the housing typically has two pieces that are detachably held together, such as by threads. Usually a spring or other biasing element is used to bias the writing tip end of the cartridge out of the pen housing. The spring or other biasing element may be attached at either the writing tip end or the butt end of the cartridge. The two pieces of the housing are detached from each other to remove and replace the cartridge.

While there are a wide variety of replacement cartridges available on the market, prior art pens are designed to accept only cartridges of a specific size. As a result, the user cannot use different brands or sizes of replacement cartridges. Therefore, there is a need in the art for a pen housing that can easily adjust to accommodate cartridges with different lengths, different thicknesses or different diameters.

SUMMARY OF THE INVENTION

A writing instrument comprising a housing, a cartridge, and a control element positioned in said housing and configured to adjust to accommodate cartridges of varying lengths. In an exemplary embodiment of the invention, the writing tip end of the cartridge protrudes 0.10 inch out of the housing. In another exemplary embodiment of the invention the control element is a setscrew. In another exemplary embodiment of the invention the position of the control element is determined by adjusting said setscrew until the cartridge protrudes 0.10 inch out of the housing. In another exemplary embodiment of the invention the control element moves longitudinally within said pen housing to accommodate the length of the cartridge.

DETAILED DESCRIPTION

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
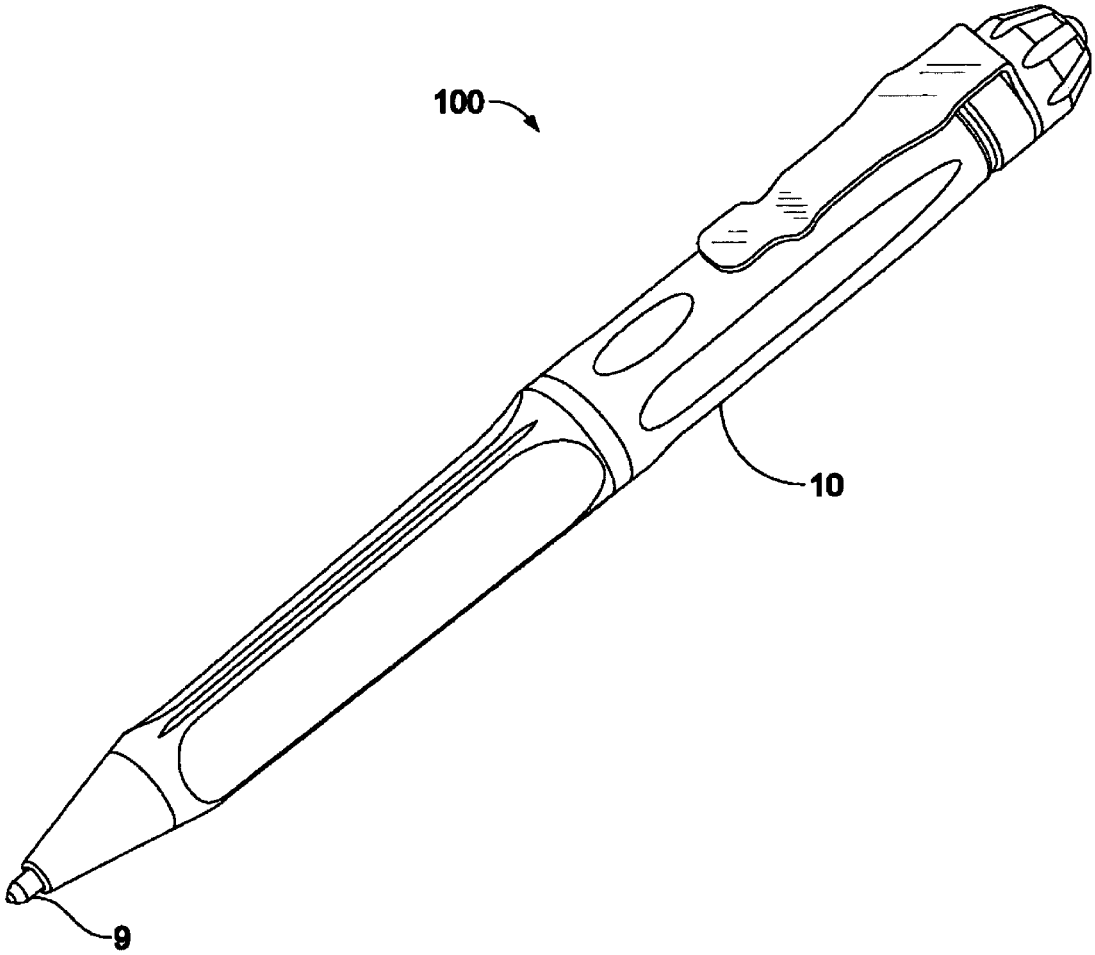
FIG. 1 is a perspective view of a pen in accordance with an embodiment of the present invention.
Figure 3:
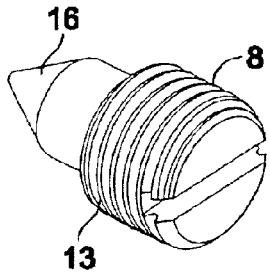
FIG. 3 is a perspective view of a flat-head setscrew in accordance with an embodiment of the present invention.
Figure 4:
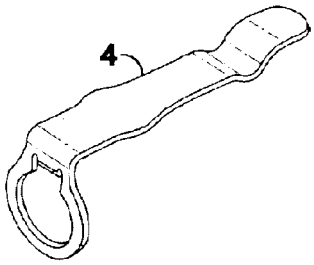
FIG. 4 is a perspective view of a pocket clip in accordance with an embodiment of the present invention.
Figure 2:
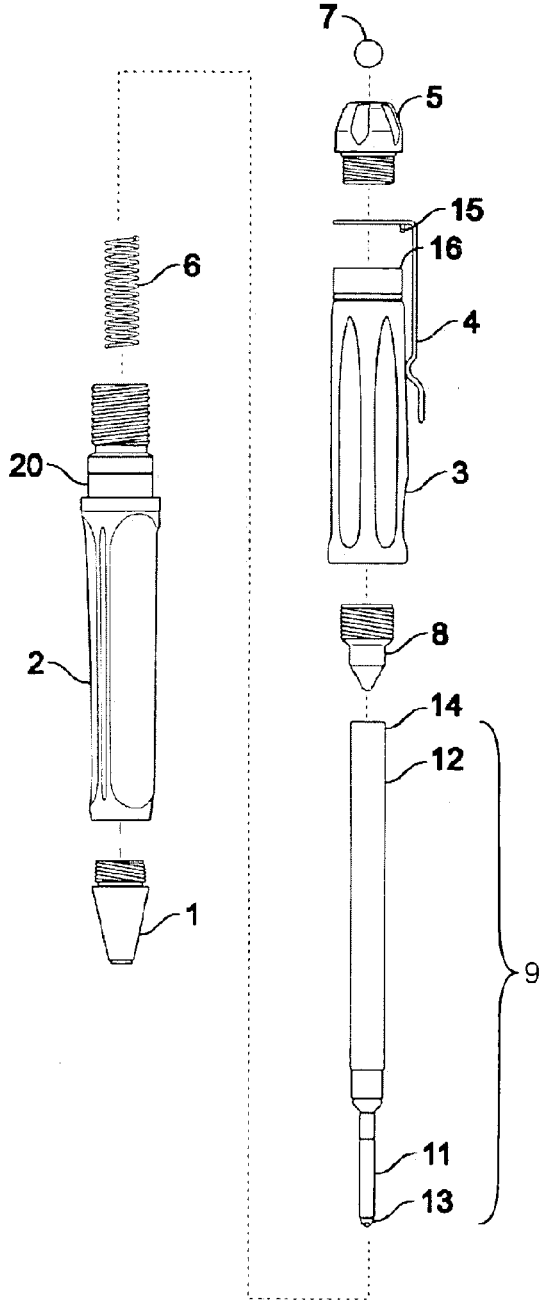
FIG. 2 is an exploded view of the pen of FIG. 1 with an exemplary cartridge.

Referring to FIGS. 1 and 2 there is shown a writing instrument, i.e., a pen 100 in accordance with a one embodiment of the present invention. The pen housing 10 includes a pen tip 1 threaded into the pen grip 2, the pen grip further threaded to the pen barrel 3 and the pen barrel in turn being threaded into the end cap 5. A control element 8, such as setscrew, is used to adjust and center the cartridge 9. As shown in FIG. 3, the setscrew 8 may have a threaded end 13 and a pin end 16. The pin end abuts to a butt end 14 of the cartridge, centering the cartridge in the pen housing 10 and fixing its position longitudinally in the pen barrel. A spring 6 in the pen tip 1 provides a further centering and recoil feel for the cartridge while the user is writing with the pen. It will be understood by those skilled in the art that the control element 8 can take a variety of forms.

Figure 5:
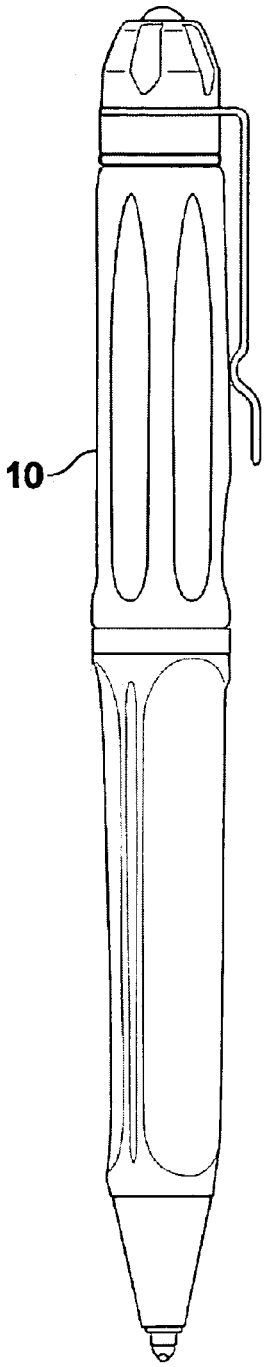
FIG. 5 is a side view of a pen in accordance with an embodiment of the present invention.
Figure 6:
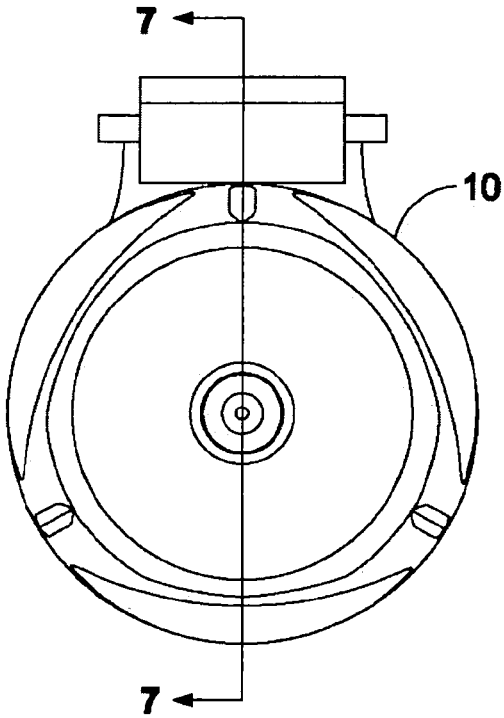
FIG. 6 is a top view of the pen housing in accordance with an embodiment of the present invention.
Figure 7:
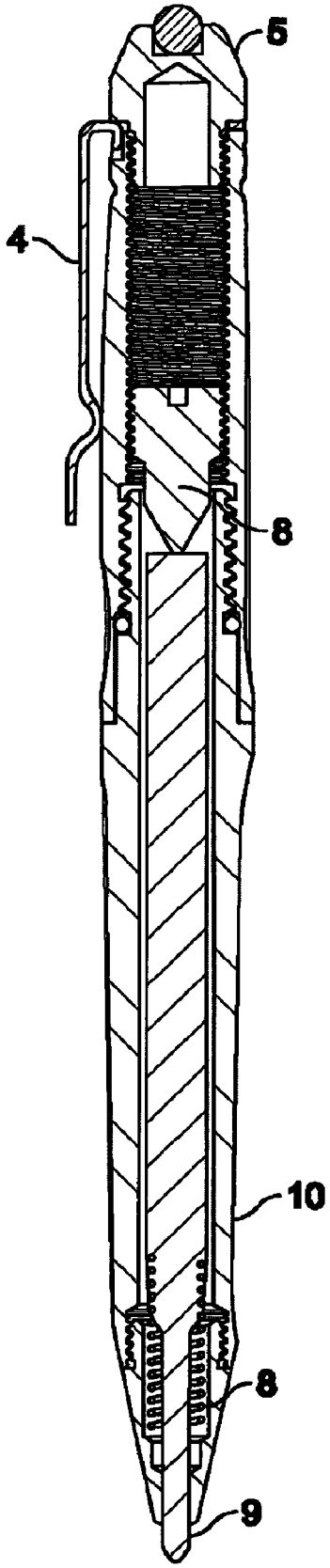
FIG. 7 is a cross-sectional view of the pen housing shown in FIG. 6.

A typical cartridge 9 has two sections, a front section 11 and a back section 12, wherein the front section 11 has a smaller diameter at the writing tip end 13 and the back section has a larger diameter at the butt end 14. The total length of the cartridge can vary, but will typically have a fixed maximum length but no minimum length requirement. The pen housing 10 of one embodiment can accommodate any cartridge that is between 3.875 and 4.25 inches long, but the present invention is not limited to that range. Similarly, the pen housing in the present invention, as shown in FIG. 5, has typically a length between 6.01-6.04 inches in length and 0.575 diameter, but is not limited to that range. The present invention can accommodate a pen of any size, and also cartridges with any range of length or diameter, or of virtually any shape.

When a cartridge needs to be replaced and/or sized in the present invention, the pen grip 2 and the pen barrel 3 are unscrewed and separated to remove the old cartridge 9. One way of installing a new cartridge is, while keeping the spring 6 in place, install the new cartridge into the pen grip and screw the pen barrel 3 back into the pen grip until the writing tip 13 of the cartridge protrudes an appropriate distance from the pen tip 1, typically approximately 0.10 inches.

If the cartridge 9 does not protrude the appropriate distance, or if the pen grip 2 and the pen barrel 3 cannot be screwed together because the new cartridge 9 is longer than previous cartridge 9, then an adjustment can be made. In one embodiment, the end cap 5 is removed and the position of the setscrew inside the pen barrel 3 is adjusted by turning the setscrew until the writing tip 13 protrudes the required distance. At this point the end cap can be re-installed. In one embodiment, when the pen is not in use, one can retract the cartridge 9 into the pen housing 10, by unscrewing pen barrel 3 from the pen grip 2 by 1.5 turns or until the marking 20 is visible.

One skilled in the art will readily recognize ways other than using a screwdriver in combination with the setscrew to adjust the position of the cartridge. For example, and without limitation, a window through the pen barrel that is capable of opening and closing, can be used to access a ratchet mechanism, which moves the cartridge distally and proximally with or without a tool.

The materials used to construct the pen housing are well known in the art. In the present invention it is preferred to use aerospace-grade aluminum with Mil-Spec Type III hard anodizing to make the body strong enough to break windows. As for the pen tip 1, pocket clip 4, and the end cap 5, stainless steel is the preferred material. The end cap 5 also features a high-polish stainless steel ball bearing 7, as shown in FIG. 2, which can be used for window breaking, more specifically a car window.

Another embodiment of the present invention utilizes a standard non-threaded "click-type" end cap instead of the threaded end cap 5 of the present invention.

Embodiments described above illustrate, but do not limit, the invention. It should also be understood that numerous modifications and variations are possible in accordance with the principles of the present invention.

What is claimed is:

1. A writing instrument comprising:

a housing having a distal portion and a proximate portion threaded together;

a cartridge disposed within the housing;

a control element positioned in said proximate portion of the housing and configured to be fixed in various position to accommodate cartridges of varying lengths;

wherein said cartridge abuts against said control element; and wherein the threading and unthreading of the distal portion and the proximate portion of the housing causes the retraction and extension of the cartridge.

2. A writing instrument according to claim 1, wherein:

a writing tip end of the cartridge protrudes 0.10 inch out of the distal portion of the housing.

3. A writing instrument according to claim 1, wherein:

said control element is a setscrew.

4. A writing instrument according to claim 3, wherein:

the position of the control element is determined by adjusting said setscrew until said cartridge protrudes 0.10 inch out of the distal portion of said housing.

5. A writing instrument according to claim 3, wherein:

said setscrew rotatably moves longitudinally within said pen housing.

6. A pen comprising:

a pen comprising:

housing having a distal portion and a proximal portion threaded together;

a cartridge disposed within the housing;

an adjustable control element disposed within said proximate portion of said housing to accommodate cartridges of varying size wherein said cartridges abuts against said control element; and wherein the threading and unthreading of the distal portion and the proximate portion causes the retraction and extension of the cartridge.

7. A pen according to claim 6, wherein:

said control element is a setscrew.

8. A pen according to claim 7, wherein:

said setscrew rotatably moves longitudinally within said pen housing, thereby accommodating the length requirement of said cartridge.

9. A pen housing comprising:

a pen tip; a pen grip; a pen barrel; and an end cap accommodating a cartridge, wherein said pen grip and said pen barrel are threaded together;

said cartridge having a writing tip end and a butt end;

a set screw threadably attached within said pen barrel to move cartridge distally and proximally to accommodate varying cartridge lengths;

wherein the butt end of said cartridges abuts against said set screw; and wherein the threading and unthreading of said pen grip and said pen barrel causes the retraction and extension of the cartridge.

10. A pen housing according to claim 9, wherein:

said setscrew has a threaded end and a pin end.

11. A pen housing according to claim 10, wherein:

said butt end of said cartridge abuts against said pin end of said set screw.

12. A pen housing according to claim 10, including:

a spring attached at said writing tip end and installed in said pen tip.

13. A pen housing according to claim 12, including:

a spring attached at said writing tip end and installed in said pen tip.

14. A pen housing according to claim 6, including:

said end cap including a ball bearing.

15. A pen housing according to claim 10, including:

a pocket pin installed between said end cap and said pen barrel.

16. A pen housing according to claim 15, wherein: said pocket pin comprise a clip tab.

17. A writing instrument comprising:

a housing comprising;

a pen grip;

a pen barrel;

a control element having a threaded end and a pin end;

a cartridge having a butt end and a tip end;

wherein the pin end of said control element abuts to a butt end of said cartridge and wherein a threading and unthreading of the pen grip and the pen barrel causes the retraction and extension of the cartridge.

* * * * *